US006254491B1

(12) United States Patent
Chou

(10) Patent No.: US 6,254,491 B1
(45) Date of Patent: Jul. 3, 2001

(54) GOLF PRACTICING DEVICE

(76) Inventor: J. P. Chou, 6H-6, 186, Section 1, Wen Hsin Rd., Taichung (TW)

( * ) Notice: Subject to any disclaimer, the term of this patent is extended or adjusted under 35 U.S.C. 154(b) by 0 days.

(21) Appl. No.: 09/005,515

(22) Filed: Jan. 12, 1998

(51) Int. Cl.[7] ..... A63B 69/36
(52) U.S. Cl. ..... 473/140; 473/146; 473/149
(58) Field of Search ..... 473/139, 140, 473/141, 143, 146, 147, 149, 387, 392, 393, 396

(56) References Cited

U.S. PATENT DOCUMENTS 2,510,266 * 6/1950 Taylor ..... 473/149
3,383,921 * 5/1968 Palmer ..... 473/146
4,023,809 * 5/1977 Newton ..... 473/146
5,178,393 * 1/1993 Dennesen ..... 473/140
5,255,920 * 10/1993 Mangeri et al. ..... 473/140
5,513,847 * 5/1996 Hu et al. ..... 473/140

* cited by examiner

*Primary Examiner*—Steven Wong
(74) *Attorney, Agent, or Firm*—Pro-Techtor International

(57) ABSTRACT

A golf practicing device includes a tube fixedly disposed to a supporting floor with a sleeve rotatably mounted to the tube, a detecting member disposed beside the tube and an illustrative member disposed on a top of the tube. The sleeve has a flange extending radially and outwardly therefrom which has a plurality of protrusions extending downwardly from a periphery of the flange so as to cooperate with the detecting member which is electrically connected to the illustrative member. A base member is attached to the sleeve and has a spherical cavity and a cone-shaped opening respectively defined therein, wherein the cone-shaped opening communicates with the spherical cavity. A rod has a ball member rotatably received in the spherical cavity and a golf ball disposed to a distal end thereof.

3 Claims, 3 Drawing Sheets

FIG,2

GOLF PRACTICING DEVICE

BACKGROUND OF THE INVENTION

1. Field of the Invention

The present invention relates to a golf practicing device and, more particularly, to an improved golf practicing device including a golf ball pivotally and rotatably connected to a sleeve which is rotatably connected with a light detecting means so as to send messages to an illustration member when the golf ball is hit.

2. Brief Description of the Prior Art

Some golf practicing devices, especially for those for practicing servicing, known to applicant are very simple and provide limited functions. Generally, the conventional golf practicing device has a golf ball connected to a rod which is then connected to a fixed member so that a golf practicer can hit the golf ball by using different types of golf clubs. The golf practicer can only know that the golf ball is hit or not when using such a golf practicing device, he/she cannot know how will the golf ball fly. In fact, when a golf ball is hit, the golf ball will self-rotate and produces at least two vectors in three dimensions. All of the above mentioned factors decide how the golf ball fly, but the conventional golf practicing device cannot provides these information so that the golf practicer could fail when servicing when he/she plays golf in court.

The present invention intends to provide an improved golf practicing device to mitigate and/or obviate the above-mentioned problems.

SUMMARY OF THE INVENTION

In one aspect of the present invention, there is provided a golf practicing device comprising a tube fixedly disposed to a supporting floor and having a detecting member disposed beside the tube. A sleeve is rotatably mounted to the tube and has a flange extending radially and outwardly therefrom which has a plurality of protrusions extending downwardly from a periphery of the flange so as to cooperate with the detecting member. A base member is attached to the sleeve and has a spherical cavity and a cone-shaped opening defined therein. The cone-shaped opening communicates with the spherical cavity.

A rod has a first end with a ball member which is rotatably received in the spherical cavity and the rod extends through the cone-shaped opening, and a second end having a golf ball disposed thereto.

An illustrative member is disposed to a top of the tube and electrically connected to the detecting member.

It is an object of the present invention to provide a golf practicing device which illustrates information how the golf ball flies.

It is another object of the present invention to provide a golf practicing device having a golf ball which is allowed to self-rotate.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
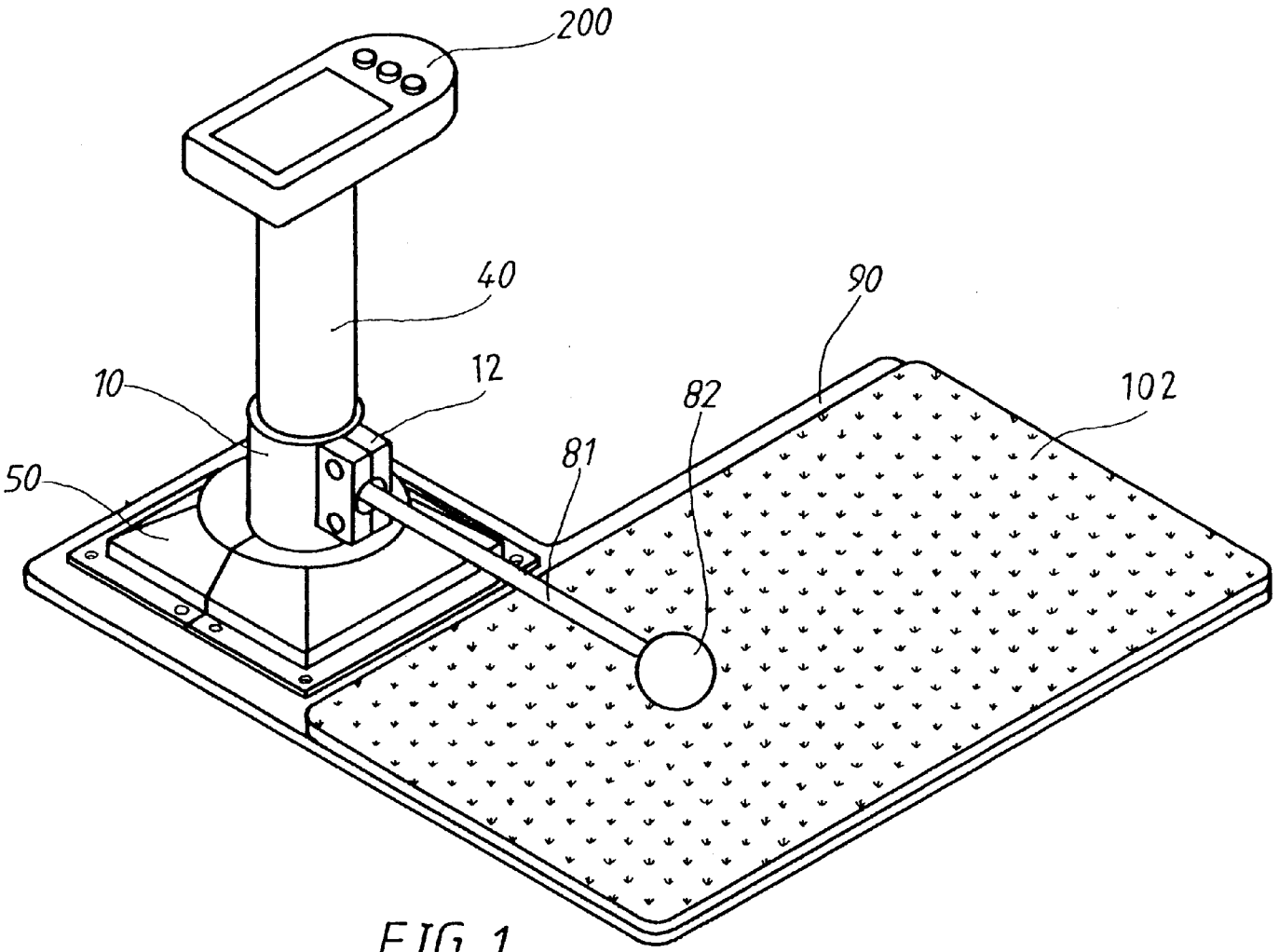
FIG. 1 is a perspective view of a golf practicing device in accordance with the present invention.
Figure 2:
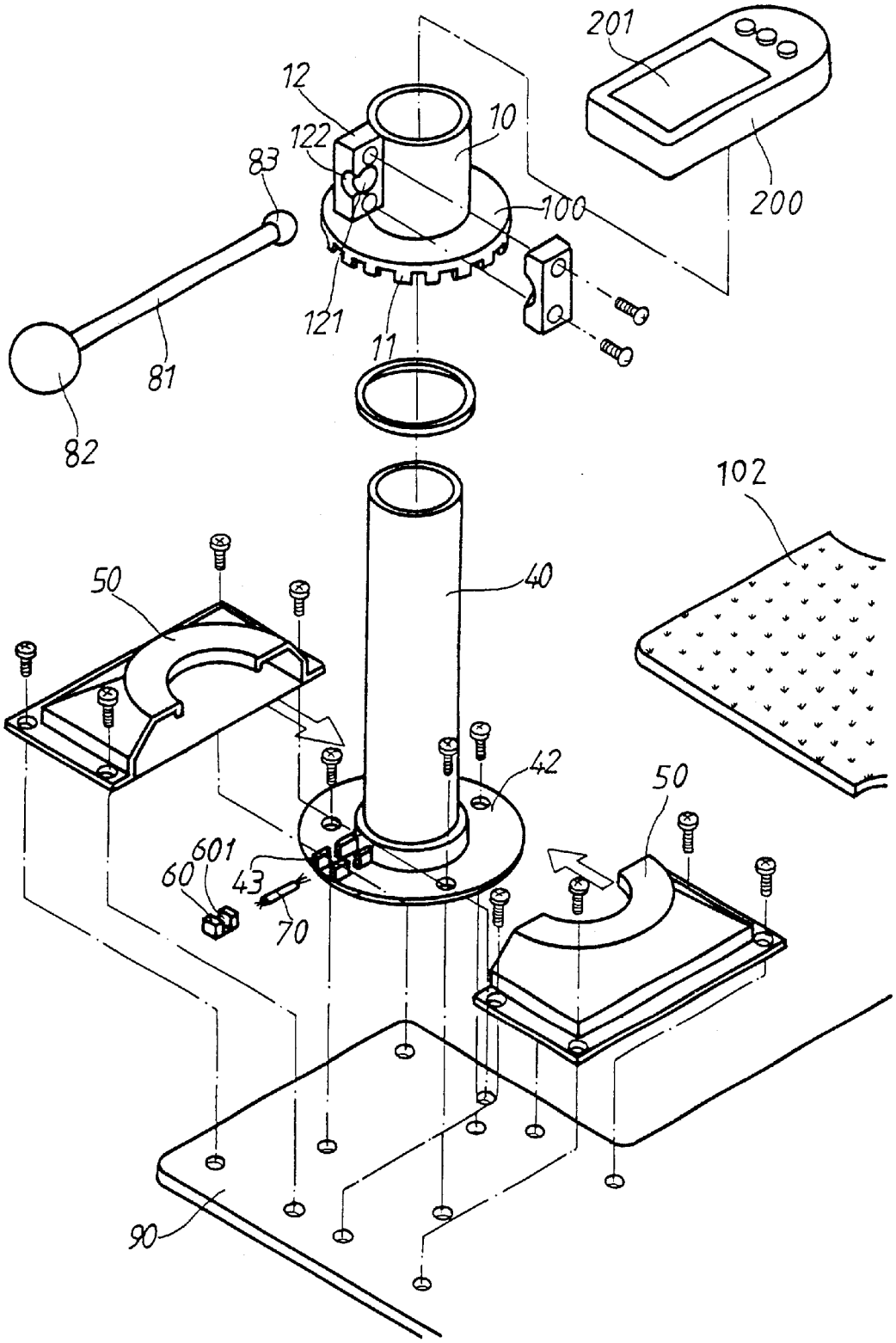
FIG. 2 is an exploded view of the golf practicing device in accordance with the present invention.
Figure 3:
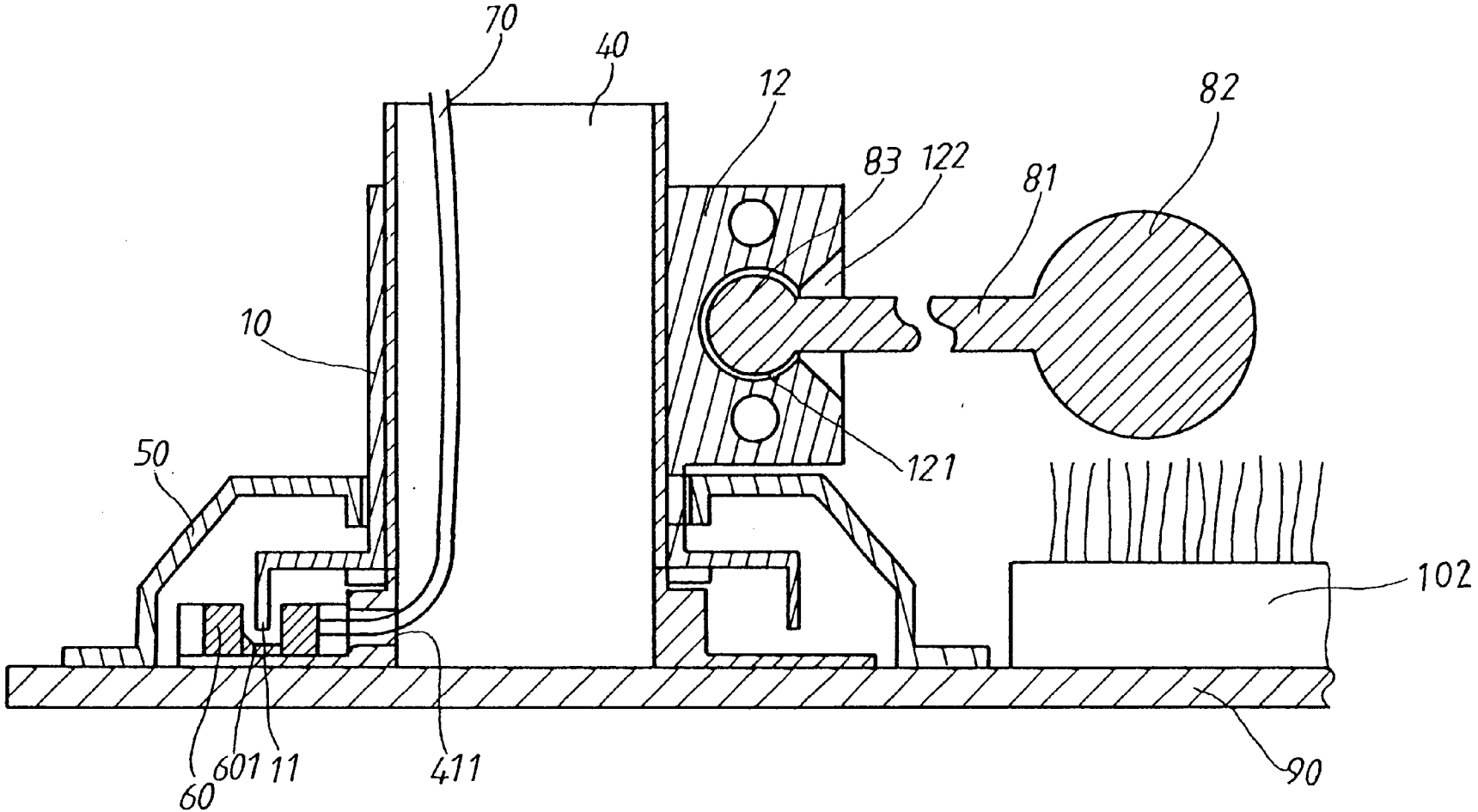
FIG. 3 is a side elevational view, partly in section, of the golf practicing device of the present invention.

Referring to FIGS. 1 through 3, a golf practicing device in accordance with the present invention generally includes a tube 40 having a lower flange 42 extending radially and outwardly therefrom so as to be fixedly disposed to a supporting floor 90 by bolts. A detecting member 60 is disposed on the lower flange 42 protected by four plates 43 extending upwardly from the lower flange 42 and located beside the tube 40. The detecting member 60 has a cut-away 601 defined therein and has a bundle of wires 70 extending therefrom which extends through a hole 411 defined in the tube 40.

A sleeve 10 is rotatably mounted to the tube 40 and has a flange 100 extending radially and outwardly therefrom which has a plurality of protrusions 11 extending downwardly from a periphery of the flange 100 at an equivalent interval so as to cooperate with the detecting member 60 by inserting into the cut-away 601. A base member 12 is attached to the sleeve 10 and composed by two halves. The base member 12 has a spherical cavity 121 and a cone-shaped opening 122 respectively defined therein, the cone-shaped opening 122 communicating with the spherical cavity 121.

A rod 81 has a first end with a ball member 83 disposed thereto so that the ball member 83 is rotatably received in the spherical cavity 121 and the rod 81 extends through the cone-shaped opening 122, and a second end having a golf ball 82 disposed thereto.

An illustrative member 200 is disposed to a top of the tube 40 and electrically connected to the detecting member 60 via the bundle of wires 70.

A cover 50 is mounted to the tube 40 and composed by two halves and covers the flange 100 and the detecting member 60 thereunder.

A pad is disposed on the supporting floor 90 so that a practicer (not shown) stands on the pad 102 and practices to service.

The ball member 83 allows the golf ball 82 to rotate and the cone-shaped opening 122 allows the rod 81 and the golf ball 82 to be hit and to produce three dimensional vectors. When the golf ball 82 is hit, the sleeve 10 is rotated on the tube 40 and the protrusions 11 pass the cut-away 601 so as to produce discontinuous signals sent to the illustrative member 200 which then transfers these signals into suitable visual images and shows the images on a screen 201 of the illustrative member 200.

The golf practicing device of the present invention provides a simple structure which illustrates images to show how the golf ball 82 flies as in a real golf court so that the practicer can correct his/her servicing according to the information shown on the screen 201.

Although the invention has been explained in relation to its preferred embodiment, it is to be understood that many other possible modifications and variations can be made without departing from the spirit and scope of the invention as hereinafter claimed.

What is claimed is:

1. A golf practicing device comprising:

a tube fixedly disposed to a supporting floor and having a detecting member disposed beside said tube;

a sleeve rotatably mounted to said tube and having a flange extending radially and outwardly therefrom which has a plurality of protrusions extending downwardly from a periphery of said flange so as to cooperate with said detecting member, a base member attached to said sleeve and having a spherical cavity and a cone-shaped opening defined therein, said cone-shaped opening communicating with said spherical cavity;

a rod having a first end with a ball member disposed thereto so that said ball member is rotatably received in said spherical cavity and said rod extends through said cone-shaped opening, and a second end having a golf ball disposed thereto, and an illustrative member disposed to a top of said tube and electrically connected to said detecting member.

2. The golf practicing device as claimed in claim 1 wherein said detecting member has a cut-away defined therein so that said protrusions extend into said cut-way.

3. The golf practicing device as claimed in claim 1 wherein a cover is mounted to said tube and which covers said flange and said detecting member thereunder.

* * * * *